United States Patent [19]

Besold

[11] Patent Number: 4,676,542

[45] Date of Patent: Jun. 30, 1987

[54] GRAVITY CLOSING TONGS

[75] Inventor: Werner Besold, Oberasbach, Fed. Rep. of Germany

[73] Assignee: M.A.N. Maschinenfabrik Augsburg-Nürnberg Aktiengesellschaft, Nuremberg, Fed. Rep. of Germany

[21] Appl. No.: 815,916

[22] Filed: Jan. 3, 1986

[30] Foreign Application Priority Data

Jan. 3, 1985 [DE] Fed. Rep. of Germany ..... 3500056

[51] Int. Cl.[4] ..... B66C 1/00

[52] U.S. Cl. ..... 294/106; 294/86.4; 294/113

[58] Field of Search ..... 294/106, 115, 119, 118, 294/104, 85, 82.22, 86.4, 91, 81.1; 414/750, 753, 749, 751

[56] References Cited

U.S. PATENT DOCUMENTS

| | | | |
|---|---|---|---|
| 3,695,670 | 10/1972 | Barnett et al. | 294/106 |
| 3,718,362 | 2/1973 | Butz | 294/106 |
| 4,336,962 | 6/1982 | Read | 294/106 |

FOREIGN PATENT DOCUMENTS 2650034 11/1979 Fed. Rep. of Germany .

*Primary Examiner*—James B. Marbert

*Attorney, Agent, or Firm*—Becker & Becker

[57] ABSTRACT

The invention relates to gravity-closing tongs for handling steel ingots, slabs, and similar products. The tongs include two legs, each of which has two arms which are supported, in a tongs housing, on pivots disposed horizontally and transversely to the plane in which the tongs legs move. The lower arms of the tongs legs are provided with gripping pins or similar devices, and the upper arms are hinged to links of equal length. An adjusting device permits axial displacement of the tongs pivots and an accumulator intensifies the force with which the tongs gripping pins are applied. In order to minimize the investment for intensifying the contact pressure of the tongs gripping pins and to mitigate impacts or shocks on the drive of the adjusting device(s), the accumulator includes two horizontally acting force-accumulating elements (compression springs) which are each arranged between the upper end of the corresponding tongs leg and the extreme end of the corresponding link. The inner ends of the links are hingedly connected by a pin which is guided in slots of the side plates of the tongs casing for vertical displacement and, being disposed transverse to the plane in which the tongs legs move, forms a toggle joint. The limited vertical displacement of the pin of the toggle joint is effected via a tension member which is connectible to the load suspension device of a crane or similar lifting equipment.

2 Claims, 4 Drawing Figures

GRAVITY CLOSING TONGS

BACKGROUND OF THE INVENTION

1. Field of the Invention

The present invention relates to gravity-closing tongs for handling steel ingots, slabs, or similar loads. the inventive tongs are provided with two two-armed legs, each of which is pivotable about a horizontal pivot which is disposed transverse to the pivoting plane of the legs and is supported in a tongs housing. The lower arms are provided with gripping pins or similar devices, and the upper arms are hinged to equal-length links. The inventive tongs or grippers are also provided with adjusting means for axially displacing the pivots, and an accumultor to intensify the gripping force of the gripping pins.

2. Description of the Prior Art

In an earlier disclosure of tongs of the type initially referred to, the accumultor is a vertically arranged compression spring, which is loaded or tensioned by means of a pull-rod that is arranged to be lifted by a hydraulic cylinder. The compression spring of the present invention causes the gripping pins in the tongs legs to be pressed onto the ingot or slab with a greater force than is obtainable in the case of gravity-closing tongs without a compression spring; moreover, it permits additional shocks, which result from vertical forces, to be mitigated.

Where tongs are provided with means to adjust their opening, however, shock-like loads or stresses are liable to arise when the gripping centers or pins contact the load which is to be picked up. These loads or stresses, which are detrimental to the drive of the adjusting means, cannot be mitrigted by the previously known and disclosed vertical spring. Therefore, according to the previously known art, it would be necessary to provide separate features to mitigate these shocks (impacts), e.g. by providing a slip coupling or similar. However, this is not a subject which was discussed in the earlier disclosure in the German Patent 26 50 034 Kropik dated Nov. 22, 1979 and belonging to the assignee of the present invention. Thus, a drawback of the previously known tongs is increased complexity thereof, which is due to the need for a separate drive for loading the compression spring and to provide separate means to mitigate the shock or impacts that act on the drive of the adjusting means.

An object of the present invention is to provide gravity-closing tongs of the type described above to intensify the contact pressure of the gripping pins of the tongs and to mitigate the shocks or impacts acting on the drive of the adjusting means with a minimum amount of effort and complexity of design. It is a further advantage of the present invention that the complete tongs can be conveniently and easily separated from the load suspension device.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
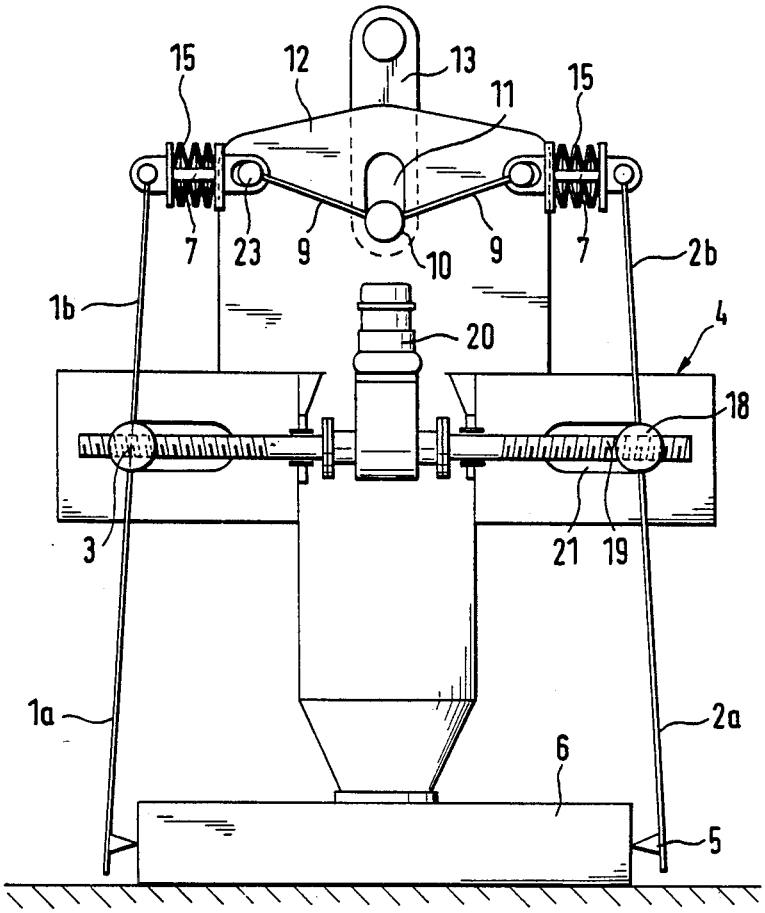
FIG. 1 is an end view of the tongs which are shown adjusted for the maximum payload width and in the process of contacting the load.
Figure 2:
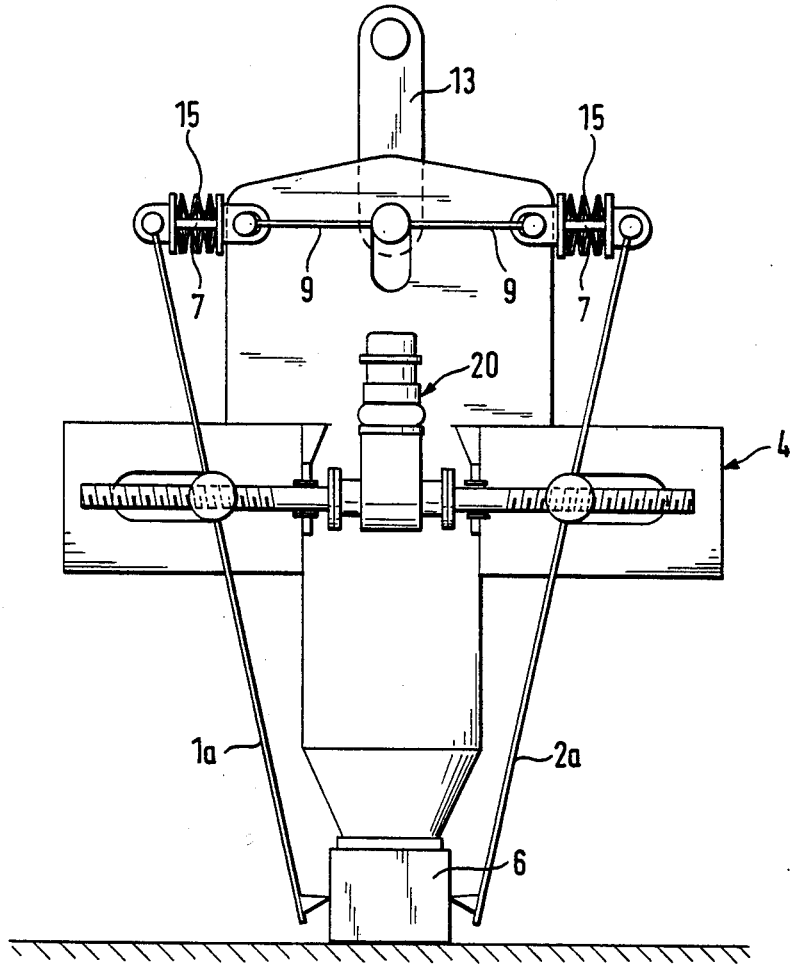
FIG. 2 is an end view of the tongs which are shown adjusted for minimum payload width and after the contact phase with the links completely extended.

The invention is characterized primarily in that the tongs are provided with two two-armed tongs legs, each of which is supported in a tongs casing on a horizontally arranged pivot that is directed transverse to the plane in which the tongs legs move. The lower arms of the tongs legs are provided with gripping pins or similar devices, and the upper arms of the tongs legs are hinged to equal-length links. the tongs are also provided with an adjusting device for displacing the pivots axially, as well as an accumulator means (or force accumulator) to intensify the tongs gripping pins contact force.

More specifically, the force accumulator is formed with two horizontally acting force accumulating elements (compression springs), each of which is arranged between the upper end of the corresponding tongs leg and the extremity or outer end of the corresponding link. The inner ends of the links are hinged to a pin, which is guided, for vertical adjustment, in slots of the side plates of the tongs casing, while the pin is disposed transverse to the pivoting plane of the tongs leg, thereby forming a toggle joint. Limited vertical displacement of the pin is effected by a tension element, which is connectible with the load suspension device of a crane or similar machine. Since the accumulators perform two functions and are loaded by means known in the art (adjusting mechanism; hoist motion of the crane), the investment is relatively small. Furthermore, the accumulators reduce or may even compensate for, the difference in the closing force which results in straight gravity- closing tongs between the maximum and minimum opening width. the tongs according to the invention will not open under conditions of rough shock-like operation and the accumulators, which are located at the ends of the upper tongs arms, will be exposed to but relatively little radiation when handling hot slabs. Finally, locating the accumulators at the upper ends of the tongs legs has a positive effect on the determination of size of the accumulators.

DESCRIPTION OF A PREFERRED EMBODIMENT

Referring now to the drawings in detail, the essentially gravity-closing tongs or clamps comprise two two-armed tongs legs 1, 2 which are movable against each other and, each of which is pivotably supported in a tongs casing or housing 4 about a respective horizontal pivot 3 that is directed transversely to the pivoting plane of the tongs legs, and is formed by the longitudinal centerline of a pin. The lower arms 1*a*, 2*a* of the tongs legs are formed with centering pins 5 which can be positioned against the sides of the payload 6 to be lifted, e.g. a steel ingot or an iron slab. Arranged in the region of the fork-shaped ends of the upper arms 1*b*, 2*b* of the tongs legs are horizontal rods 7 which are axially movable over a limited distance and which are flexibly connected via inner rod heads 8 and pins or bolts 23 hingedly connected within holes disposed on equal-length links 9. The inner ends of these links 9 are hinged by means of their holes or bores on a pin 10, which is directed transversely to the pivoting plane of the tongs legs. The pin 10 is vertically slidably guided in slots 11 of side plates 12 which extend vertically upwards and which are an integral part of the tongs casing 4. For vertical displacement of the pin 10, the latter is supported in holes or bores disposed on the fork-shaped end of the tension member 13. The tension member 13 is provided, at its upper end, with a hole by means of which it can be suspended on the hook of a crane or can be quickly connected and disconnected by means of a pin to the load suspension device (lifting beam) of a crane. The pins 23 are supported in oblong-hole-shaped openings in the side plates 12, thereby permitting a limited axial displaceability (spring travel), but no vertical displacemnt relative to the side plates 12.

Figure 3:
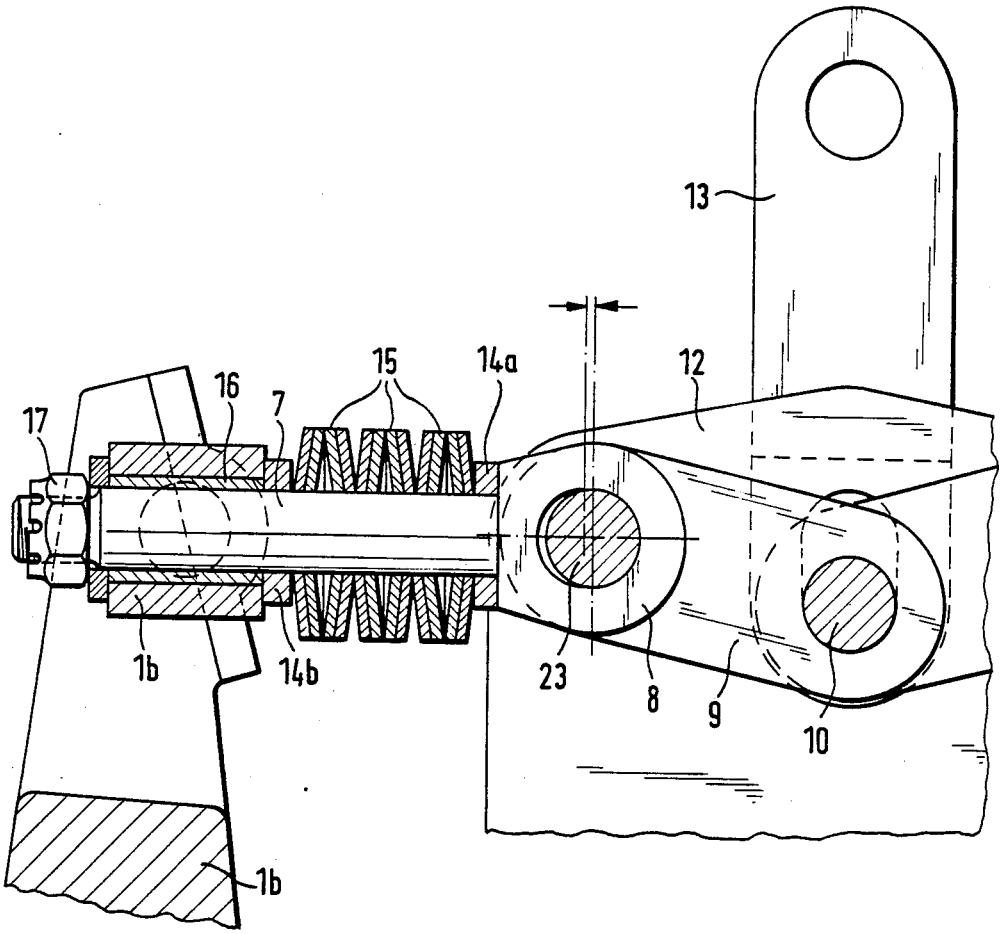
FIG. 3 is a fragmentary view of detail shown partially sectioned and on a larger scale than in FIGS. 1 and 2.
Figure 4:
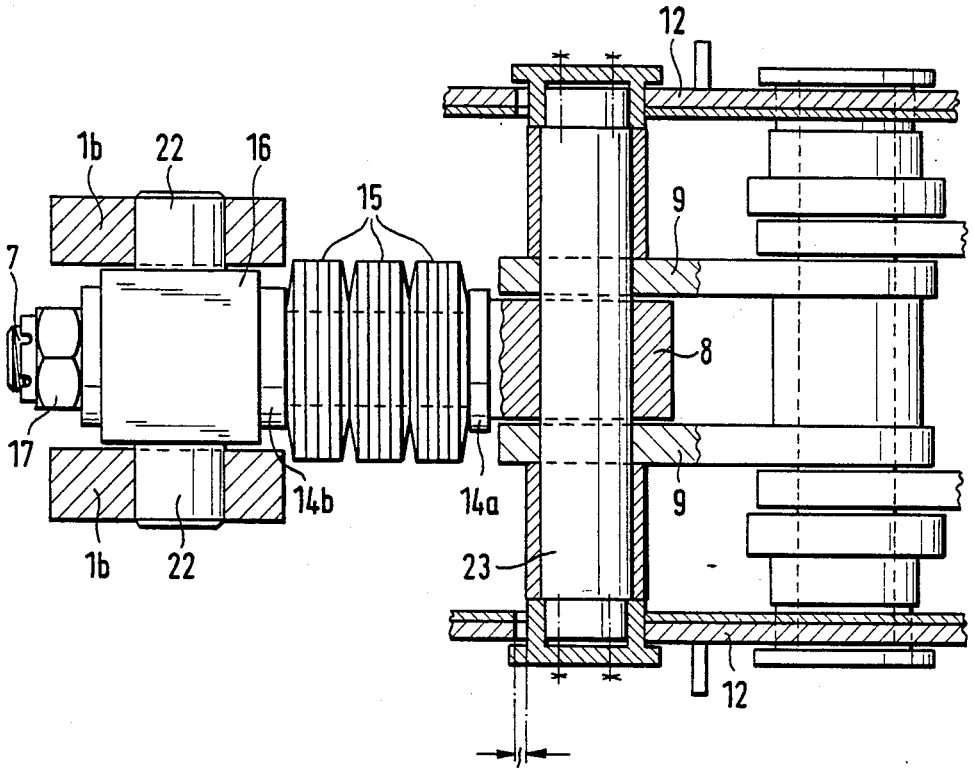
FIG. 4 is a partially sectioned plan view of the detail shown in FIG. 3.

Threaded or otherwise disposed on each of the two rods 7 are two spring rests or seats 14*a*, 14*b*, between each set of which is arranged a pre-loadable, single-acting stack of ring-shaped cup springs 15. The inner spring seats 14*a* each bear against an inner vertical end face of the associated rod head 8 and the outer spring seats 14*b* each bear against a vertical end face of the associted upper arm of the tongs leg. The outer spring seats 14*b* are each firmly connected to a traverse or member 16 which is disposed on the rod 7. Each member is hingedly supported by means of two trunnions or pins 22, which are arranged in a line on opposite sides, and are directed transversely to, the longitudinal extent of the associated rod 7, and are disposed within the holes of the fork-shaped end of the associated upper arm 1*b* or, respectively, 2*b*, of the tongs legs. The rods 7 extend through the members 16 and continue to extend outwardly for a certain length. On each outer end of the rods 7 there is a nut 17 which, under the conditions represented in FIGS. 3, 4,—as a result of a corresponding spacer—bears on the outer vertical end face of the associated upper arm 1*b* or, respectively, 2*b* of the tongs legs.

In order to permit the opening width of the tongs legs to be adjusted to various widths of the payload 6, a self-locking adjusting device of a type known in the art is provided (with reverse inefficiency). To this end, the pivots of the tongs legs are supported on nuts 18 which are axially movable in guide slots 21 of the tongs housing 4 by means of screws 19, which are rotatable preferably by means of a central drive 20—i.e. a drive which is arranged at the center of the tongs.

The operation of the tongs according to the invention is as follows:

The opened tongs are placed in such a position, over the payload 6 which is to be picked up from a support on which it rests, so that, on activating the adjusting device 18, 19, 20, the gripping pins 5 of the tongs securely grip the payload. The adjusting device is started by an operator, in the course of which the tongs legs 1, 2, which are in their outermost possible positions, are shifted towards the center of the tongs until the gripping pins 5 are lightly pressed against the sides of the payload. The movement of the pivots of the tongs legs is stopped when the gripping pins 5 contact the payload. Any impacts or shocks due to the gripping pins hitting the payload are thus avoided as a result of the compression or cup springs 15 being loaded by the adjusting device 18, 19, 20. This occurs when the members 16 are moved axially inwardly on the rods 7, since the pins 23 are pressed together with the rod heads 8 by the compression springs 15 into their inner end positions in the oblong holes. The motor of the drive of the adjusting device 18, 19, 20 then comes to a standstill, and the brake of the drive of the adjusting device is automatically applied, whereupon an electric switching relay causes the motor of the drive of the adjusting device to be de-energized or switched off. After the adjusting drive has been switched off, the hoist motion of the crane or similar lifting equipment is initiated, whereupon the pin 10, which upon adjustment of the tongs leg pivot is in its bottommost end position, is moved upwards. During this vertical movement, the links 9 are brought from their obliquely downward directed position into their extended position which is controlled by the top end of the slots 11, i.e. into the position where they are horizontally in line. When the links 9 have assumed their extended positions, this position can no longer be released from the outside. As a result of the toggle action of the links 9 moving into their extended position, the compression springs 15—which have already been partly compressed by the adjusting device 18, 19, 20—are additionally loaded as a result of the pins 23 and the rods 7 being outwardly displaced (while the members 16 remain stationary). As a result of the loaded compression springs 15, the contact force of the gripping pins, which is given in the case of straight gravity-closing tongs by the weight of the payload being lifted and the weight of the tongs components, is further increased by a certain pre-selected constant value.

The present invention is, of course, in no way restricted to the specific disclosure of the specificiation and drawings, but also encompasses any modifications within the scope of the appended claims.

What I claim is:

1. A tongs for handling a load including particularly steel ingots slabs and similar products grasped laterally to close under weight of tongs legs and the load, which comprises:

a tongs housing which is provided with plates having slots;

said tongs legs including a first leg and a second leg, each of which is provided with a first arm and a second arm, with both of said legs being supported in said tongs housing on a horizontally arranged pivot, that is disposed transverse to a plane in which said tongs legs move; each of said first and said second arms being provided with a first end and a second end, with said second ends of said second arms being provided with gripping means and with said first ends of said first arms being hingedly connected to equal-length links, and with said second ends of said first arms being operatively connected to said first ends of said second arms; via said pivot;

an adjusting means supported by said housing, with said adjusting means being provided for displacing said pivots axially;

a respective horizontally-acting accumulator element to increase tongs engagement force beyond a predetermined extent prescribed by weight of the load and additionally effective for impact- and shock protection as disposed between each said first end of said first arm and a first end of the associated links, with each said link also having a second end that is hinged in the manner of a toggle joint, to a pin that is guided in said slots for vertical adjustment of the position of the pin, and with said pin also being disposed transverse to the plane; and a tension element having a first end which is connected to said pin for limiting said vertical adjustment, with said tension element also having a second end which is connectible to a lifting apparatus.

2. A tongs according to claim 1, wherein said respective accumulator element comprises:

ring-shaped cup springs;

two horizontal rods upon which said cup springs are arranged and each provided respectively with a rod head at inner ends of said rods, said rod heads each having a bore;

a pin means guided through said bore respectively;

said pin means additionally being guided through holes of associated ends of said links;

side plates having slots in which said pin means are supported;

a pair of spring rests between which said cup springs respectively are arranged so that inner spring rests engage against vertical ends of said rod beads and outer spring rests engage against vertical ends of upper tongs-legs arms;

a traverse member with which said outer spring rests are rigidly connected, surrounding said rod and providing two trunnion pins oriented transverse to length of said rod associated therewith;

said trunnion pins being pivotally journaled in recesses of an end part of upper tongs-legs arms respectively associated therewith;

said rods passing respectively through said traverse member and projecting outwardly therefrom; and a nut respectively arranged upon projecting ends of said rods provided with threads.

* * * * *